US009272556B1

(12) United States Patent
Shih

(10) Patent No.: US 9,272,556 B1
(45) Date of Patent: Mar. 1, 2016

(54) PORTABLE STAMP

(71) Applicant: SUN SAME ENTERPRISES CO., LTD., Tainan (TW)

(72) Inventor: Wen-Jer Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 0 days.

(21) Appl. No.: 14/529,213

(22) Filed: Oct. 31, 2014

(51) Int. Cl.

| | |
|---|---|
| ***B41K 1/42*** | (2006.01) |
| ***B41F 31/00*** | (2006.01) |
| ***B41K 1/40*** | (2006.01) |
| ***B41K 1/56*** | (2006.01) |
| ***B41K 1/50*** | (2006.01) |
| ***B43K 29/00*** | (2006.01) |
| ***B43K 29/013*** | (2006.01) |

(52) U.S. Cl.
CPC ... *B41K 1/40* (2013.01); *B41K 1/42* (2013.01); *B41K 1/50* (2013.01); *B41K 1/56* (2013.01); *B43K 29/00* (2013.01); *B43K 29/013* (2013.01)

(58) Field of Classification Search
CPC ..... B41K 1/002; B41K 1/04; B41K 1/006; B41K 1/50; B41K 1/40; B41K 1/42; B41K 1/56; B43K 29/013; B43K 29/00
USPC ..... 101/327, 333, 334, 405, 406
See application file for complete search history.

(56) References Cited

U.S. PATENT DOCUMENTS

| | | | | |
|---|---|---|---|---|
| 396,233 | A * | 1/1889 | Reynolds | B43K 29/013 101/333 |
| 1,085,143 | A * | 1/1914 | Malsch | B41K 1/54 101/333 |
| 2,627,227 | A * | 2/1953 | Claggett | B41K 1/003 101/333 |
| 5,118,212 | A * | 6/1992 | Shao | B43K 29/013 101/333 |
| 6,290,419 | B1 * | 9/2001 | Hirschmann | B43K 29/013 101/333 |
| 6,526,882 | B1 | 3/2003 | Shih | |
| 6,679,168 | B1 | 1/2004 | Shih | |
| 6,708,613 | B2 * | 3/2004 | Faber | B43K 29/013 101/333 |
| 6,925,933 | B1 | 8/2005 | Shih | |

* cited by examiner

*Primary Examiner* — Matthew G Marini
*Assistant Examiner* — Marissa Ferguson Samreth
(74) *Attorney, Agent, or Firm* — Alan D. Kamrath; Kamrath IP Lawfirm, P.A.

(57) ABSTRACT

A portable stamp has a stamp housing, and a driving member, an ink member with an ink pad and a stamp seat for mounting a stamp pad mounted in the stamp housing. An operating member is mounted through a guiding slot of the stamp housing and is connected to the driving member. Each of the ink member and the stamp seat is pivotally connected to the driving member via a pivot rod and a torsion spring. By pushing the driving member, the ink member and the stamp seat can be driven to selectively pivot out of the stamp housing or be folded in the stamp housing. When the portable stamp is folded, a stamping surface of the stamp pad that is mounted on the stamp seat is sure to touch the ink pad of the ink member and be coated with the ink uniformly.

2 Claims, 7 Drawing Sheets

PORTABLE STAMP

BACKGROUND OF THE INVENTION

1. Field of the Invention

The present invention relates to a stamp, especially to a portable stamp that can be folded and unfolded and allows a user to carry along.

2. Description of the Prior Art(s)

A conventional portable stamp comprises a stamp housing, and a driving member, an ink member and a stamp seat mounted in the stamp housing. An operating member is mounted through a sidewall of the stamp housing and is connected to the driving member. Each of the ink member and the stamp seat is pivotally mounted on the driving member via a pivot rod and a torsion spring. The ink member has an ink pad. The stamp seat is used for mounting a stamp pad that has a stamping surface. When the conventional portable stamp is folded, the ink member and the stamp seat are received in the stamp housing. Thus, a room that the conventional portable stamp occupies can be reduced, and the stamp pad can touch the ink pad of the ink member to be coated with ink.

When a user intends to stamp patterns with the conventional portable stamp, the operating member is pushed to drive the ink member and the stamp seat to slide outside the stamp housing. The two torsion springs respectively push the ink member and the stamp seat with the stamp pad to rotate toward an exterior of the stamp housing by 90 degrees, such that the stamp seat is rotated to a bottom of the stamp housing. Thus, the user can hold the stamp housing with his hand, and stamp the patterns on papers with the stamp pad that is on the bottom of the stamp housing.

The foregoing conventional portable stamp allows the user to carry it along and can be coated with ink automatically. However, in order to provide sufficient room for the operating member, the ink member, and the stamp seat with the stamp pad to move inside the stamp housing, clearances are designed to exist between the operating member, the ink member, the stamp seat, and the stamp housing when the ink member and the stamp seat are folded in the stamp housing. Moreover, after the conventional portable stamp is used for some time, the ink pad may become thin due to pressing, and the stamp pad may also become thin due to wearing down. Therefore, the stamp pad is unable to touch the ink pad with the whole stamping surface.

To overcome the shortcomings, the present invention provides a portable stamp to mitigate or obviate the aforementioned problems.

SUMMARY OF THE INVENTION

The main objective of the present invention is to provide a portable stamp. The portable stamp has a stamp housing, a driving member, an operating member, an ink member with an ink pad, and a stamp seat for mounting a stamp pad. The driving member, the ink member, and the stamp seat are mounted in the stamp housing. The operating member is mounted through a guiding slot of the stamp housing and is connected to the driving member. Each of the ink member and the stamp seat is pivotally connected to the driving member via a pivot rod and a torsion spring.

By pushing the driving member, the ink member and the stamp seat can be driven to selectively pivot out of the stamp housing or be folded in the stamp housing.

Each of at least one lateral sidewall of the stamp housing has a positioning recess. The positioning recess is formed in an inner surface of the lateral sidewall and extends through a lower edge of the lateral sidewall. Each of at least one side edge of the ink member has a positioning protrusion. Each positioning protrusion selectively engages in a corresponding positioning recess of the stamp housing, such that the ink member can be folded at a specific position in the stamp housing.

When the portable stamp is folded, the stamping surface of the stamp pad that is mounted on the stamp seat is sure to touch the ink pad of the ink member and be coated with the ink uniformly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
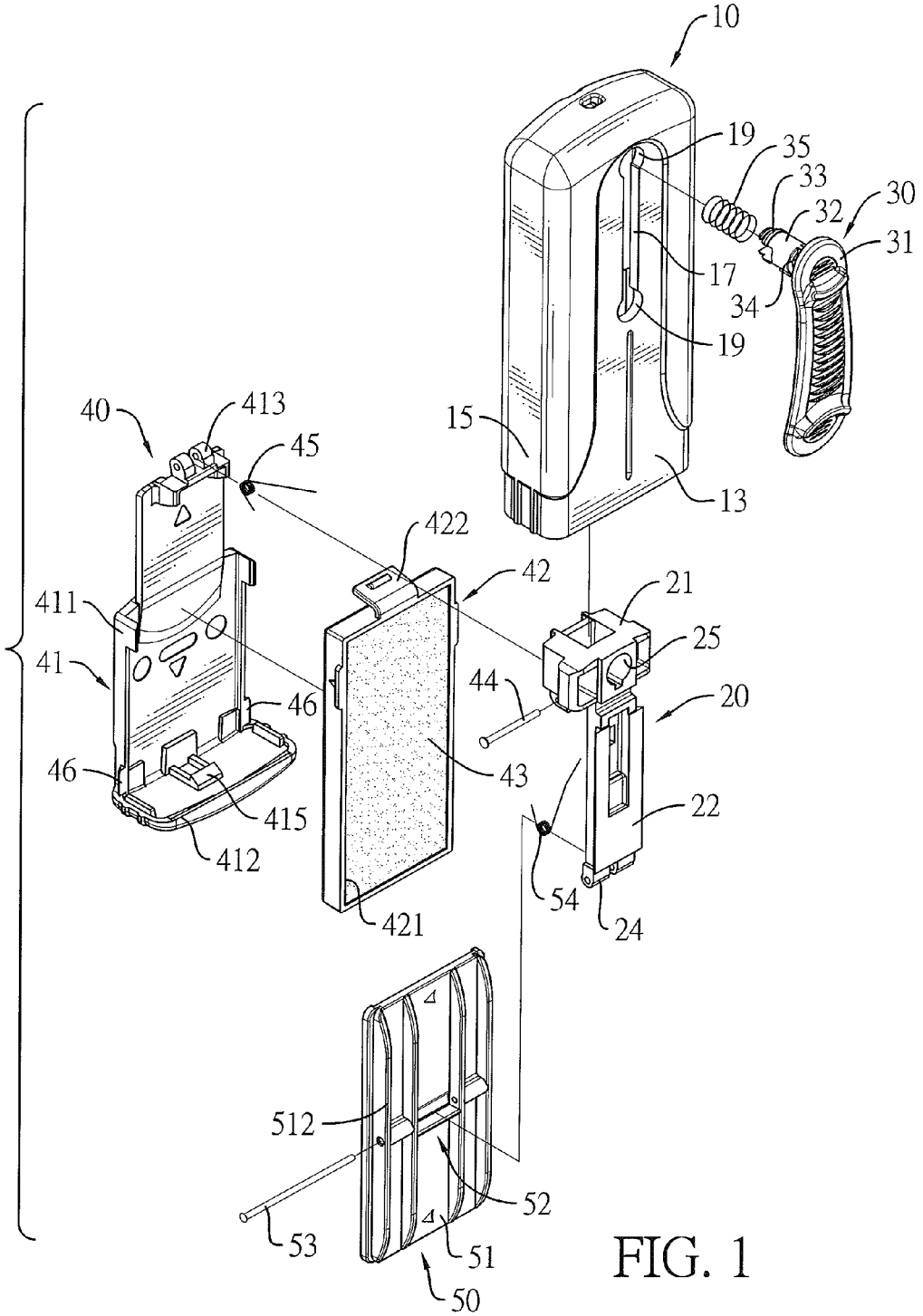
FIG. 1 is an exploded perspective view of a portable stamp in accordance with the present invention.
Figure 2:
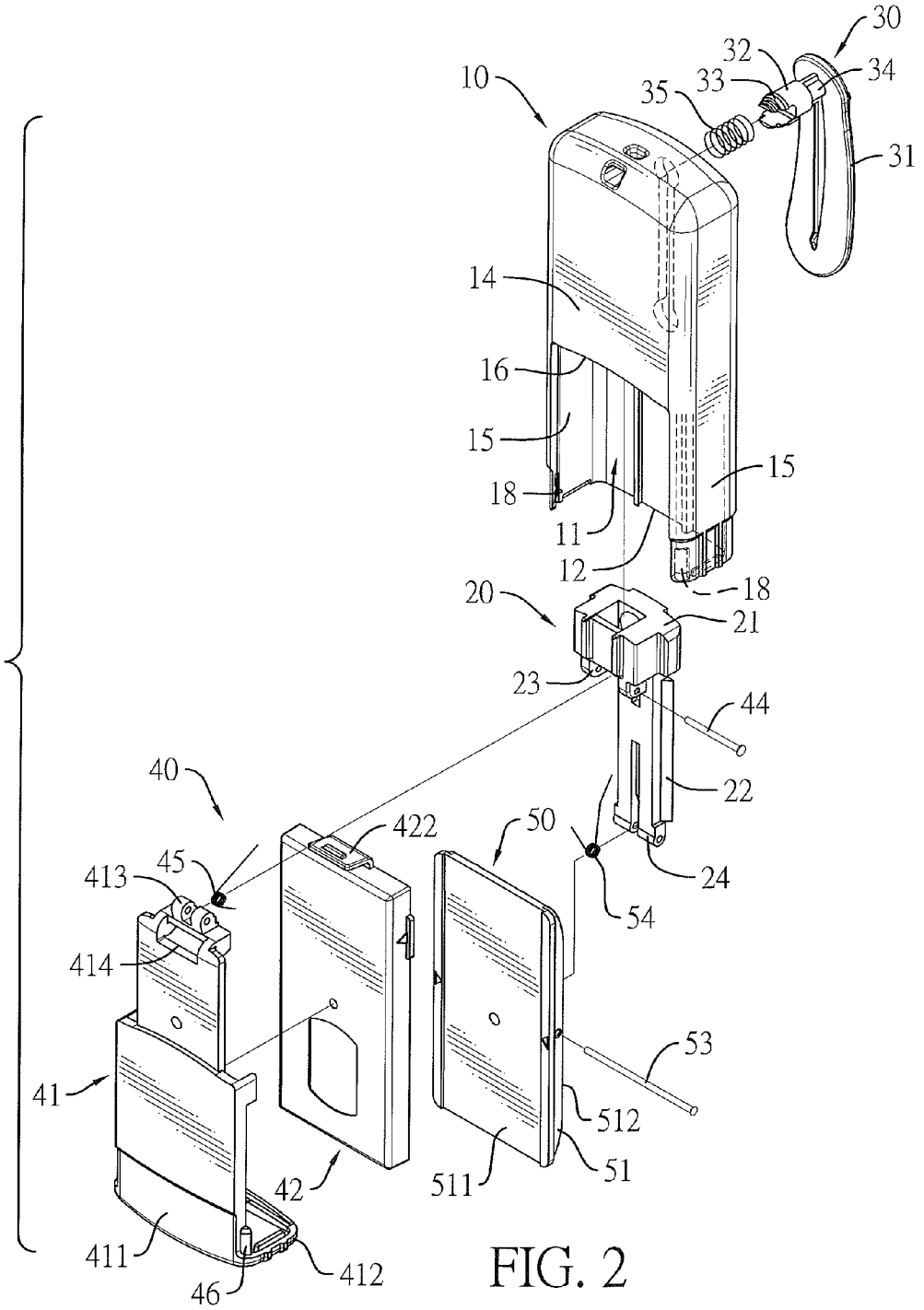
FIG. 2 is another exploded perspective view of the portable stamp in FIG. 1.

With reference to FIGS. 1 and 2, a portable stamp in accordance with the present invention comprises a stamp housing 10, a driving member 20, an operating member 30, an ink member 40, and a stamp seat 50.

Figure 3:
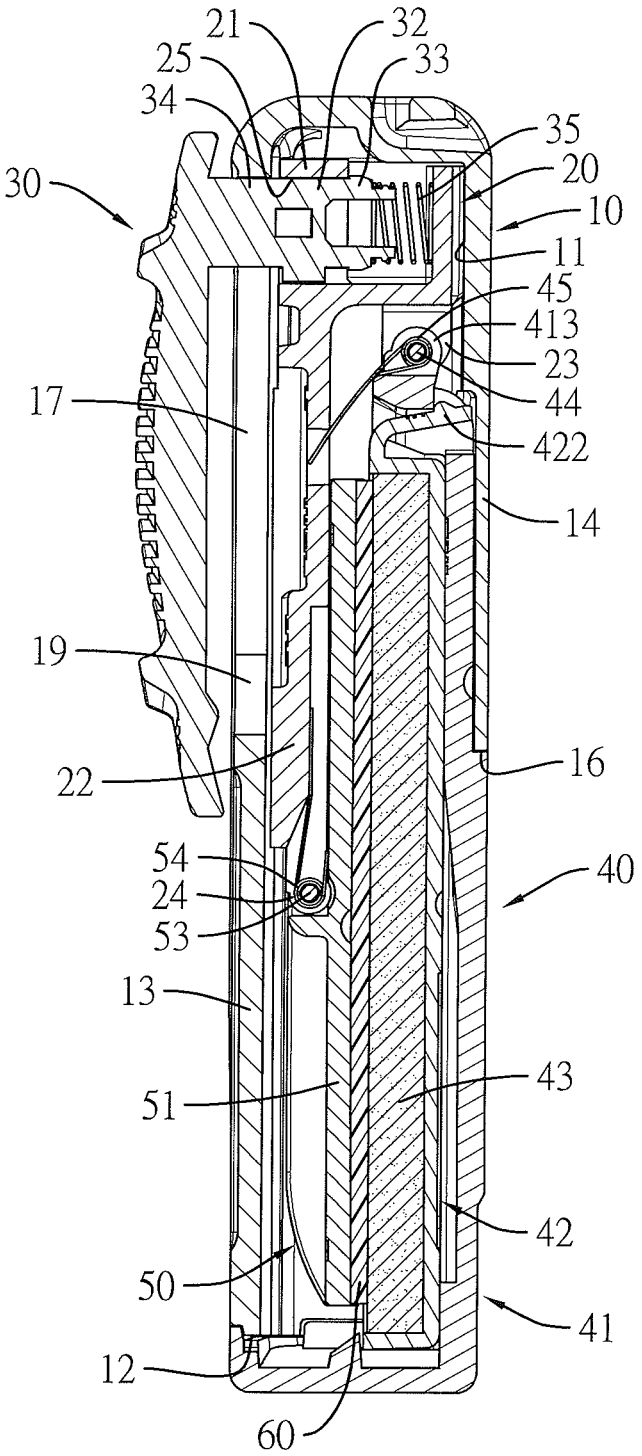
FIG. 3 is a cross-sectional side view of the portable stamp in FIG. 1, shown folded.
Figure 4:
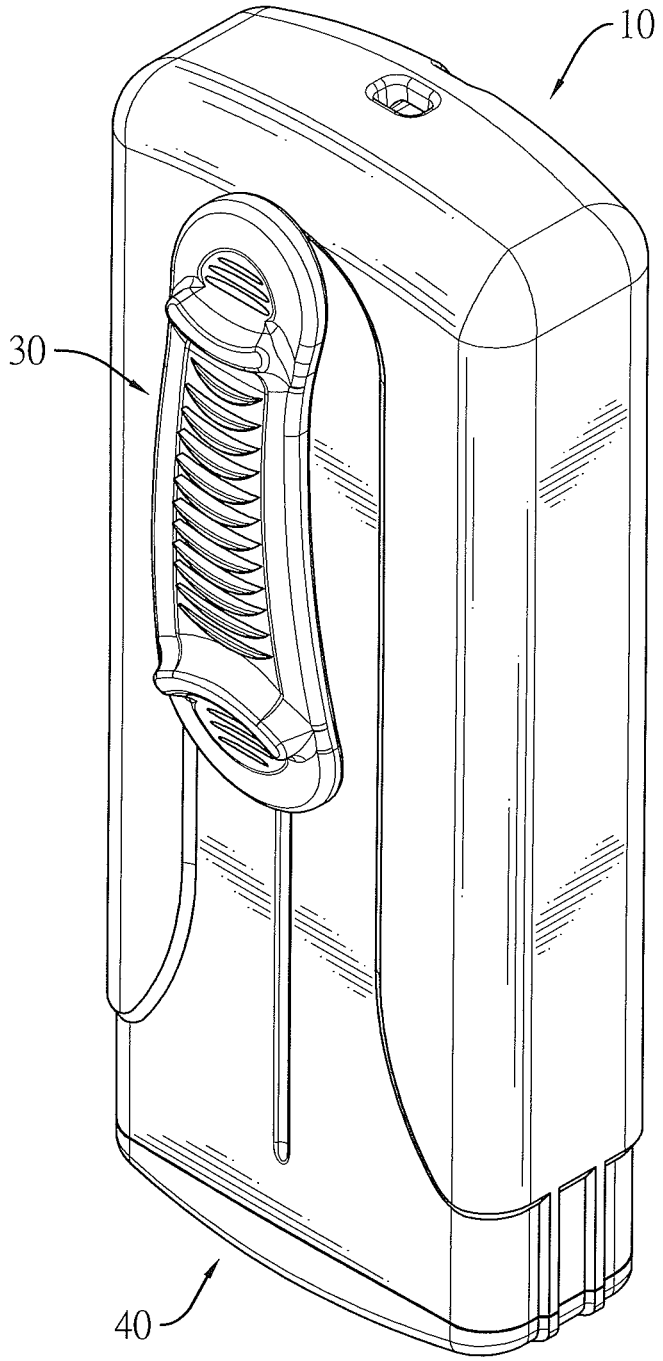
FIG. 4 is a perspective view of the portable stamp in FIG. 4, shown folded.

With reference to FIGS. 1 to 3, the stamp housing 10 has a mounting chamber 11, a lower opening 12, a first sidewall 13, a second sidewall 14, and two lateral sidewalls 15.

The mounted chamber 11 is formed inside the stamp housing 10. The lower opening 12 is formed on a bottom of the stamp housing 10 and communicates with the mounting chamber 11.

The first sidewall 13 has a guiding slot 17 and two mounting holes 19. The guiding slot 17 extends longitudinally, communicates with the mounting chamber 11, and has two ends. The mounting holes 19 are respectively formed at and enlarged relative to the two ends of the guiding slot 17, and communicate with the guiding slot 17. The second sidewall 14 is opposite to the first sidewall 13 and has a moving recess 16. The moving recess 16 is formed through the second sidewall 14 and extends through a lower edge of the second sidewall 14. The lateral sidewalls 15 are oppositely formed between the first sidewall 13 and the second sidewall 14. At least one of the lateral sidewalls 15 has a positioning recess 18. The positioning recess 18 is formed in an inner surface of the lateral sidewall 15 and extends through a lower edge of the lateral sidewall 15.

As shown in FIGS. 1 to 3, the driving member 20 is longitudinally slidably mounted in the mounting chamber 11 of the stamp housing 10 and has a base 21, an extended arm 22, an ink pivot portion 23, and a stamp pivot portion 24. The base 21 has an assembling hole 25. The assembling hole 25 corresponds in position to the guiding slot 17 of the stamp housing 10. The extended arm 22 protrudes down from the base 21 and toward the lower opening 12 of the stamp housing 10, and has a distal edge and a side surface. The side surface of the extended arm 22 faces the moving recess 16 of the stamp housing 10. The ink pivot portion 23 is formed on the base 21 and is disposed beside the side surface of the extended arm 22. The stamp pivot portion 24 is formed on the distal edge of the extended arm 22.

As shown in FIGS. 1 to 3, the operating member 30 is slidably mounted on the first sidewall 13 of the stamp housing 10 and has a handle 31 and a connecting rod 32. The handle 31 is mounted on an outer surface of the first sidewall 13 of the stamp housing 10 and has a contacting surface, an inner surface, and a non-slip portion. The inner surface of the handle 31 is opposite to the contacting surface and faces the first sidewall 13. The non-slip portion is formed on the contacting surface of the handle 31 and may be fluted or grained. The connecting rod 32 protrudes from the inner surface of the handle 31, is mounted through the guiding slot 17 of the first sidewall 13, protrudes in the assembling hole 25 of the driving member 20, and is connected to the driving member 20.

With the connecting rod 32 sliding along the guiding slot 17, the guiding slot 17 limits a sliding range of the operating member 30. Accordingly, a user can drive the driving member 20 to slide via the operating member 30 and within the limited sliding range of the operating member 30.

As shown in FIGS. 1 to 3, in the preferred embodiment, the connecting rod 32 of the operating member 30 has a distal end, an end stop 33 and a neck portion 34. The end stop 33 is formed adjacent to the distal end of the connecting rod 32. The neck portion 34 is formed between the end stop 33 and the handle 31, and is slidable in the guiding slot 17 of the stamp housing 10. An outer diameter of the end stop 33 corresponds in size to an inner diameter of each of the mounting holes 19, and is larger than an outer diameter of the neck portion 34.

Thus, the end stop 33 of the operating member 30 can be mounted through one of the mounting holes 19 that are disposed at the ends of the guiding slot 17, mounted in the assembling hole 25 of the base 21 of the driving member 20, and then connected to the base 21 of the driving member 20.

Furthermore, a compression spring 35 is mounted around the distal end of the connecting rod 32, and has two ends respectively abutting the end stop 33 and the base 21 of the driving member 20. With the compression spring 35 pushing the operating member 30, the end stop 33 is disposed in one of the mounting holes 19 that are disposed at the ends of the guiding slot 17. Accordingly, the operating member 30 is held at a specific position. When the operating member 30 as well as the compression spring 35 are pressed, the end stop 33 departs from the mounting hole 19 and the neck portion 34 is disposed in the mounting hole 19, instead. Then, the neck portion 34 of the operating member 30 can slide along the guiding slot 17 of the stamp housing 10, and the driving member 20 can be driven by the operating member 30.

Figure 5:
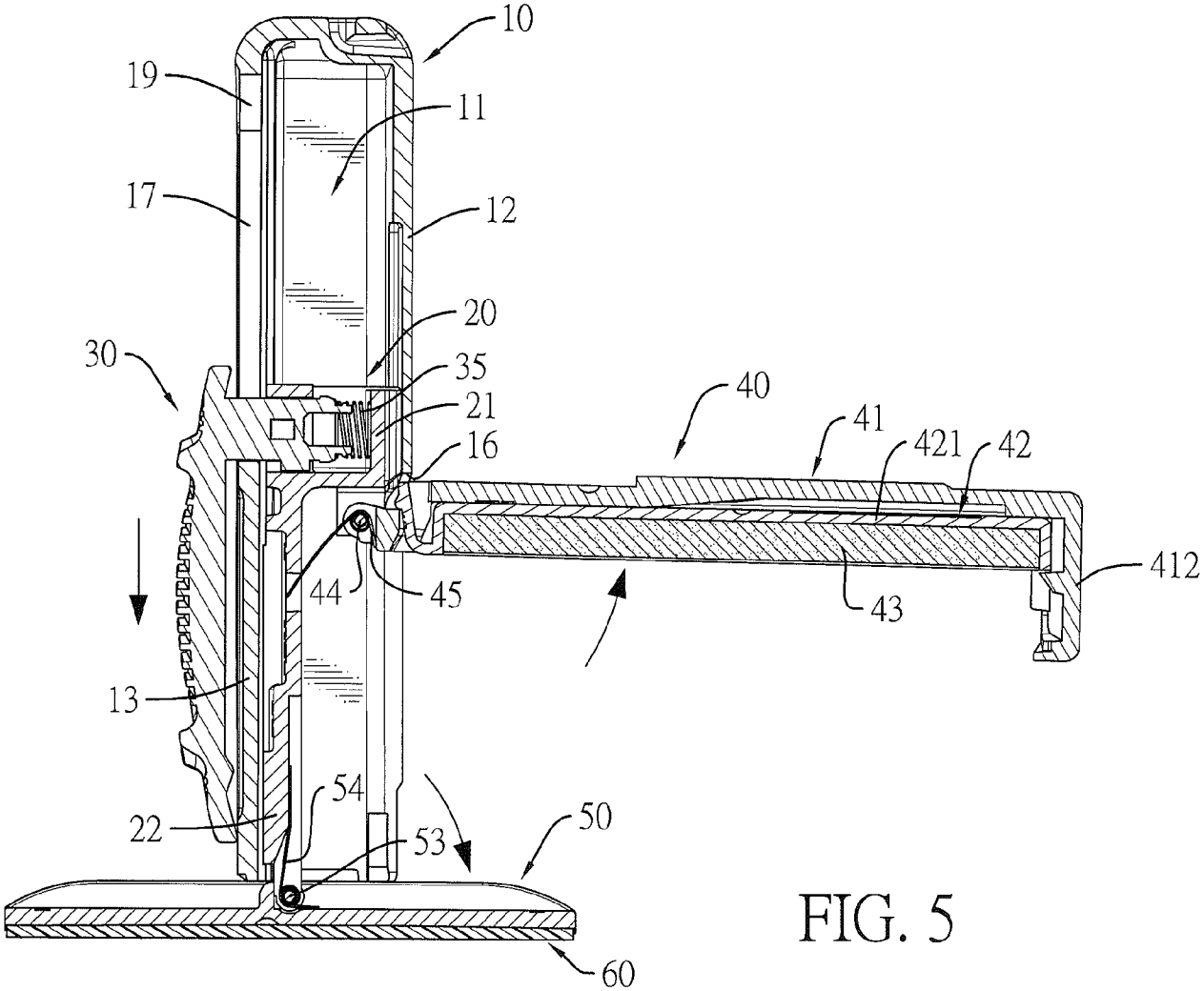
FIG. 5 is an operational cross-sectional side view of the portable stamp in FIG. 1, shown unfolding.

As shown in FIGS. 1 to 3, the ink member 40 is used for providing ink and is pivotally mounted to the ink pivot portion 23 of the driving member 20 via a first pivot rod 44 and a first torsion spring 45. Two ends of the first torsion spring 45 respectively abut against the ink member 40 and the extended arm 22 of the driving member 20. With reference to FIGS. 3 and 5, thus, the ink member 40 can selectively pivot inwardly to be arranged beside the side surface of the extended arm 22 or pivot outwardly to protrude through the moving recess 16. The ink member 40 has two opposite side edges. At least one of the side edges of the ink member 40 has a positioning protrusion 46. The positioning protrusion 46 selectively engages in a corresponding positioning recess 18 of the stamp housing 10, such that the ink member 40 can be folded at a specific position in the stamp housing 10.

As shown in FIGS. 1 to 3, in the preferred embodiment, the ink member 40 includes an ink bracket 41, an ink cartridge 42, and an ink pad 43 soaked with the ink.

The ink bracket 41 has a main panel 411, an end pivot portion 413, an end panel 412, an engaging hole 414, and a positioning hook 415. The main panel 411 has two opposite end edges and two opposite side edges. The end pivot portion 413 is formed on one of the end edges of the main panel 411 and is pivotally mounted to the ink pivot portion 23 of the driving member 20 via the first pivot rod 44 and the first torsion spring 45. The end panel 412 is formed on the other end edge of the main panel 411, protrudes inwardly, and has a side surface. The side surface of the end panel 412 faces toward the end pivot portion 413. The engaging hole 414 is formed adjacent to the end pivot portion 413. The positioning hook 415 is formed on the side surface of the end panel 412. The positioning protrusion 46 is formed on at least one of the side edges of the main panel 411 and is disposed adjacent to the end panel 412.

The ink cartridge 42 is detachably mounted on the ink bracket 41 and is hooked by the positioning hook 415 of the ink bracket 41. The ink cartridge 42 has an end edge, a side surface, a mounting recess 421, and a resilient engaging panel 422. The side surface of the ink cartridge 42 faces the extended arm 22 of the driving member 20. The mounted recess 421 is formed in the side surface of the ink cartridge 42. The resilient engaging panel 422 is formed on the end edge of the ink cartridge 42 and engages in the engaging hole 414 of the ink bracket 41. The ink pad 43 is mounted in and protrudes out of the mounting recess 421 of the ink cartridge 42.

With the positioning hook 415 of the ink bracket 41 hooking the ink cartridge 42 and with the resilient engaging panel 422 of the ink cartridge 42 engaging in the engaging hole 414 of the ink bracket 41, the ink cartridge 42 can be securely mounted on the ink bracket 41 and is detachable.

As shown in FIGS. 1 to 3, the stamp seat 50 includes a mount 51 and a pivot portion 52. The mount 51 has a mounting surface 511 and a back surface 512. The mounting surface 511 is used for mounting a stamp pad 60 with a stamping surface. The back surface is opposite to the mounting surface. The pivot portion 52 of the stamp seat 50 is formed at a middle of the back surface 512 of the mount 51 and is pivotally mounted to the stamp pivot portion 24 of the driving member 20 via a second pivot rod 53 and a second torsion spring 54. Two ends of the second torsion spring 54 respectively abut against the extended arm 22 of the driving member 20 and the mount 51 of the stamp seat 50. Thus, when the portable stamp is folded, the ink member 40 and the stamp seat 50 with the stamp pad 60 are arranged side by side in the stamp housing 10, to allow the stamp pad 60 on the stamp seat 50 to touch the ink pad 43 of the ink member 40 and be coated with the ink.

With reference to FIGS. 3 and 5, when the user intends to stamp patterns with the portable stamp, the operating member 30 and the compression spring 35 are pressed, the end stop 33 of the operating member 30 departs from one of the mounting holes 19, and the neck portion 34 of the operating member 30 is disposed in the mounting hole 19 instead. With the neck portion 34 of the operating member 30 sliding along the guiding slot 17 of the stamp housing 10, the operating member 30 and the driving member 20 can be pushed downwardly to drive the ink member 40 and the stamp seat 50 with the stamp pad 60 to pivot out of the stamp housing 10 from the lower opening 12. The first torsion spring 45 and the second torsion spring 54 push the ink member 40 and the stamp seat 50 to pivot out of the stamp housing 10, such that the back surface 512 of the mount 51 of the stamp seat 50 abuts against the bottom of the stamp housing 10, and the stamping surface of the stamp pad 60 faces downward. Then, the compression spring 35 pushes the operating member 30, so the end stop 33 slides into the other mounting hole 19 of the stamp housing 10. Thus, the operating member 30 is held at the specific position, and the user can stamp the patterns with the stamp pad 60.

As shown in FIGS. 3 and 5, when folding the portable stamp, the operating member 30 and the compression spring 35 are pressed, the end stop 33 of the operating member 30 departs from the mounting hole 19, and the neck portion 34 of the operating member 30 is disposed in the mounting hole 19. With the neck portion 34 of the operating member 30 sliding along the guiding slot 17 of the stamp housing 10, the operating member 30 and the driving member 20 can be pushed upwardly to drive the ink member 40 and the stamp seat 50 with the stamp pad 60 to pivot to be folded side by side in the stamp housing 10.

Figure 6:
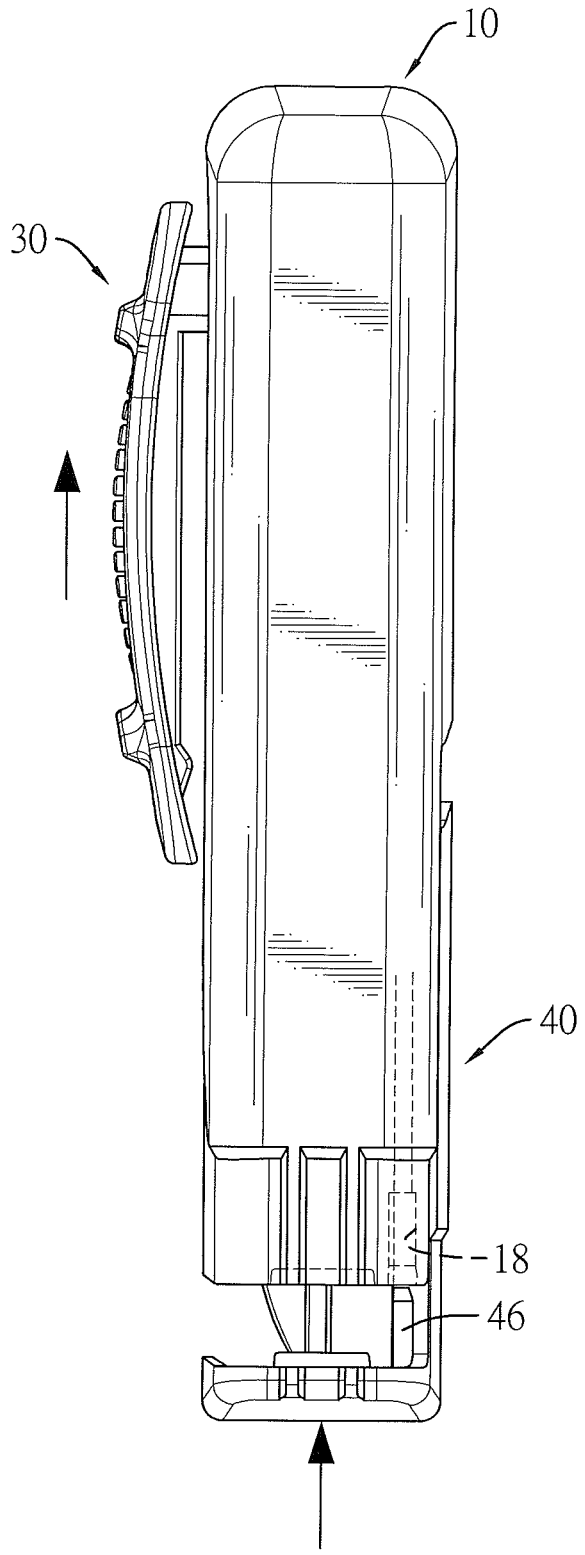
FIG. 6 is an operational side view of the portable stamp in FIG. 1, shown folding.
Figure 7:
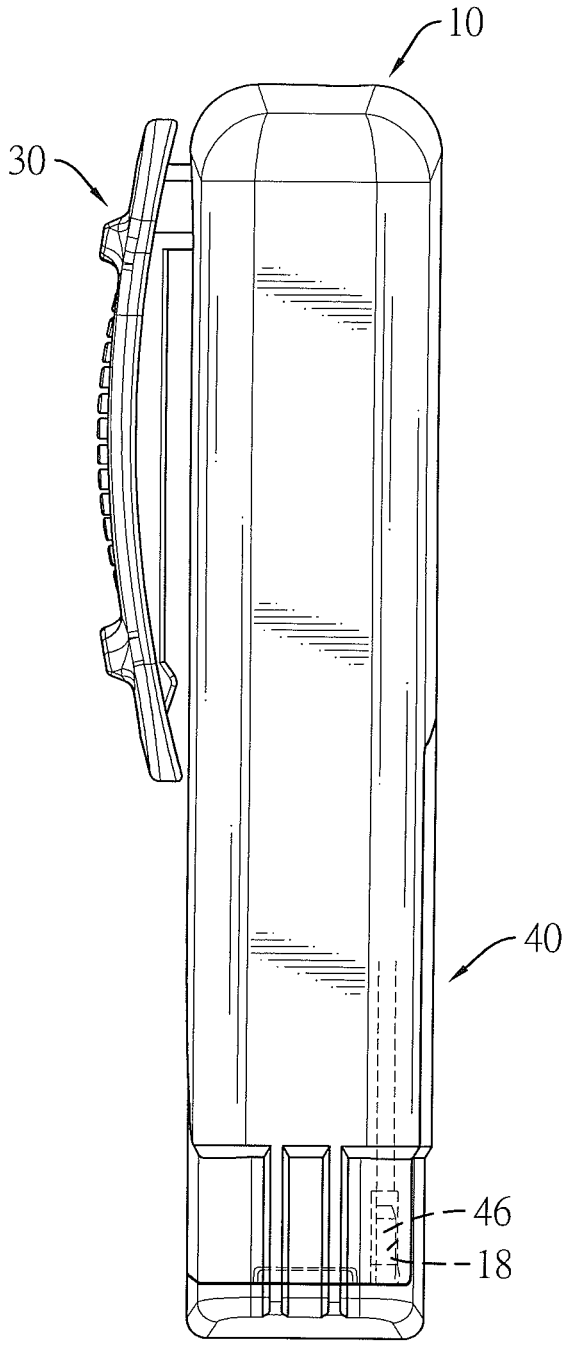
FIG. 7 is a side view of the portable stamp in FIG. 1, shown folded.

With reference to FIGS. 3, 6, and 7, when folding the portable stamp, each positioning protrusion 46 of the ink member 40 selectively engages in the corresponding positioning recess 18 of the stamp housing 10, such that the ink member 40 is folded at the specific position in the stamp housing 10. As shown in FIG. 3, when the portable stamp is folded, the stamping surface of the stamp pad 60 that is mounted on the stamp seat 50 is sure to touch the ink pad 43 of the ink member 40 and be coated with the ink uniformly.

Even though numerous characteristics and advantages of the present invention hive been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A portable stamp comprising:

a stamp housing having:

a mounting chamber;

a lower opening formed on a bottom of the stamp housing and communicating with the mounting chamber;

a first sidewall having a guiding slot, with the guiding slot extending longitudinally and communicating with the mounting chamber;

a second sidewall opposite to the first sidewall; and two lateral sidewalls oppositely formed between the first sidewall and the second sidewall, with at least one of the two lateral sidewalls having a positioning recess, with the positioning recess formed in an inner surface of the at least one of the two lateral sidewalls and extending through a lower edge of the at least one of the two lateral sidewalls;

a driving member longitudinally slidably mounted in the mounting chamber of the stamp housing;

an operating member slidably mounted on the first sidewall of the stamp housing and having:

a handle mounted on an outer surface of the first sidewall of the stamp housing; and a connecting rod protruding from an inner surface of the handle, mounted through the guiding slot of the first sidewall, and connected to the driving member;

an ink member with ink, with the ink member pivotally mounted to the driving member via a first pivot rod and a first torsion spring and having two opposite side edges, with at least one of the two side edges of the ink member having a positioning protrusion, with the positioning protrusion selectively engaging in the positioning recess of the stamp housing; and a stamp seat for mounting a stamp pad with a stamping surface, with the stamp seat pivotally mounted to the driving member via a second pivot rod and a second torsion spring, wherein:

the stamp seat and the ink member are selectively arranged side by side in the stamp housing, or driven to pivot out of the stamp housing;

the first sidewall of the stamp housing further has two mounting holes respectively formed at and enlarged relative to two ends of the guiding slot, and communicating with the guiding slot;

the second sidewall of the stamp housing has a moving recess formed through the second sidewall and extending through a lower edge of the second sidewall;

the connecting rod of the operating member has:

a distal end;

an end stop formed adjacent to the distal end of the connecting rod, mounted through one of the two mounting holes of the stamp housing, and connected to the driving member; and a neck portion formed between the end stop and the handle and slidable in the guiding slot of the stamp housing;

a compression spring is mounted around the distal end of the connecting rod, and has two ends respectively abutting the end stop and the driving member;

the ink member selectively pivots to protrude through the moving recess of the stamp housing;

an outer diameter of the end stop corresponds in size to an inner diameter of each of the two mounting holes, and is larger than an outer diameter of the neck portion;

the driving member has:

a base having an assembling hole;

an extended arm protruding from the base and toward the lower opening of the stamp housing, and having a side surface facing the moving recess of the stamp housing;

an ink pivot portion formed on the base and disposed beside the side surface of the extended arm; and a stamp pivot portion formed on a distal edge of the extended arm;

the connecting rod of the operating member protrudes in the assembling hole of the driving member;

the ink member includes:

an ink bracket having:

a main panel having two opposite end edges and two opposite side edges;

an end pivot portion formed on one of the two opposite end edges of the main panel and pivotally mounted to the ink pivot portion of the driving member via the first pivot rod and the first torsion spring; and an end panel formed on another of the two end edges of the main panel, protruding inwardly, and having a side surface, with the side surface of the end panel facing toward the end pivot portion;

an ink cartridge detachably mounted on the ink bracket; and an ink pad soaked with the ink, and mounted in and protruding out of the ink cartridge;

the positioning protrusion of the ink member is formed on at least one of the two opposite side edges of the main panel and is disposed adjacent to the end panel;

the stamp seat includes:

a mount having a mounting surface and a back surface opposite to each other; and a pivot portion formed at a middle of the back surface of the mount and pivotally mounted to the stamp pivot portion of the driving member via the second pivot rod and the second torsion spring; and the stamp pad with the stamping surface is mounted on the mounting surface of the mount.

2. The portable stamp as claimed in claim 1, wherein:

the ink bracket of the ink member further has:

an engaging hole formed adjacent to the end pivot portion of the ink bracket; and a positioning hook formed on the side surface of the end panel; and the ink cartridge of the ink member is hooked by the positioning hook of the ink bracket and has:

an end edge;

a side surface facing the extended arm of the driving member;

a mounting recess formed in the side surface of the ink cartridge and receiving the ink pad; and a resilient engaging panel formed on the end edge of the ink cartridge and engaging in the engaging hole of the ink bracket.

* * * * *